US007591769B1

(12) United States Patent
Benjamin et al.

(10) Patent No.: US 7,591,769 B1
(45) Date of Patent: Sep. 22, 2009

(54) APPARATUS FOR ISOLATING LOWER BACK MUSCLES

(76) Inventors: Scott J. Benjamin, 7673 Hidden Lake Dr., Perry, MI (US) 48872; Roy H. Bechtel, 5492 Harvest Scene Ct., Columbia, MD (US) 21044

( * ) Notice: Subject to any disclaimer, the term of this patent is extended or adjusted under 35 U.S.C. 154(b) by 0 days.

(21) Appl. No.: 12/082,570

(22) Filed: Apr. 12, 2008

(51) Int. Cl.
*A63B 21/068* (2006.01)
*A63B 21/00* (2006.01)
*A63B 26/00* (2006.01)

(52) U.S. Cl. ..... 482/95; 482/131; 482/142

(58) Field of Classification Search ..... 482/95, 482/96, 140, 142, 131, 143, 144, 907
See application file for complete search history.

(56) References Cited

U.S. PATENT DOCUMENTS 4,332,381 A * 6/1982 Lyons ..... 482/140
4,398,713 A * 8/1983 Ellis ..... 482/145
5,176,603 A * 1/1993 Hundley et al. ..... 482/140
5,190,513 A * 3/1993 Habing et al. ..... 482/145
5,935,050 A * 8/1999 Shahan ..... 482/142
6,287,244 B1 * 9/2001 Boos ..... 482/142
6,387,024 B1 * 5/2002 Monti et al. ..... 482/142
6,692,418 B2 * 2/2004 Shahan ..... 482/144
6,827,676 B2 * 12/2004 Kuo ..... 482/144

* cited by examiner

*Primary Examiner*—Loan H Thanh
*Assistant Examiner*—Allana Lewin
(74) *Attorney, Agent, or Firm*—Knechtel, Demeur & Samlan

(57) ABSTRACT

An exercise equipment apparatus for isolating lower back muscles. The apparatus or device comprises main tubular support posts, secondary tubular support posts, and support feet for providing the foundation of the device. Inner tubular extensions and setting pins are used to adjust the height and length of the device to accommodate the particular size and the proper positioning of the user for the angle of strengthening desired. A removeable torso support is releaseably attached or coupled to one of the main tubular support posts. An angular setting guide is used to select or set the desired angle of use and an articulating lever attached to the removeable torso support provides an arm for stopping or setting the removeable torso support at the selected angle of use by the user.

16 Claims, 4 Drawing Sheets

APPARATUS FOR ISOLATING LOWER BACK MUSCLES

I. CROSS-REFERENCE TO RELATED APPLICATION

Not applicable.

II. FIELD OF THE INVENTION

The present invention relates to exercise equipment and, more particularly, to an exercise equipment apparatus for isolating and strengthening the lower back muscles and specifically, the multifidus muscles.

II. BACKGROUND AND DESCRIPTION OF THE PRIOR ART

Most Americans during their lifetime will experience some form of pain in their lower back which will cause them problems such as frustrating discomfort, disabled function from movement or bending, possible incapacitation or debilitation in extreme cases, loss of sleep, psychological impact and, in other cases, even be the catalyst to loss of employment. As a result, persons with lower back pain will either fight through the pain with the assistance of the application of heat and ice in the hope that the pain will subside or, alternatively, seek medical consultation and treatment by medication. At first blush, this may seem like a sensible plan since it is possible to weather painful episodes in this manner. Unfortunately, the pain typically returns and when it does, the symptoms are worse as more areas of the back or legs are now affected. This creates a vicious cycle of pain and disability. The reason for this cycle is that when a painful episode in the lower back is exhausted (i.e., lessened or even appear gone), the muscles in the lower back remain affected and can even become atrophied. As a person experiences more and more painful episodes in the lower back over time, changes occur in the muscle fibers which further increase the frequency of the painful episodes and, thereby, continue to cause them problems.

While muscle strengthening programs aimed at training the lumbar spine muscles are widely supported as being important and even crucial in the life of a person with lower back pain, a more complete model of lower back pain takes into account changes in muscles at the cellular level. Persons who have lower back pain not only have discomfort but experience changes in the muscle force output and a reduction in the nerve signal which prevents the muscle from functioning properly. This model is referred to as a neuromusculoskeletal model and was originally proposed by Panjabi. Essentially, pain causes inhibition to a particular muscle system. The problem is that the lumbar spine muscles must support the movement patterns whether small or large and they also need to stabilize intersegmental motion to avoid damaging ligaments and joint capsules. Lack of muscle control can cause lumbar spine segments to move excessively, giving rise to the pain and discomfort. Clinicians who treat first time, second time, or chronic lower back pain need to focus on what causes a muscle to contract and on how to reduce the inhibition to a particular segmental level. Neuromusculoskeletal dysfunction can lead to poor spinal motion and also a reduction in the ability of a person to perform sports and life activities to their optimal abilities. Neurophysiological control is therefore vital for the spinal cord segmental levels to provide motor control signals to the muscle.

There is a unique relationship between the medial branch of the dorsal ramus of the spinal nerve and the muscles that are at the same segmental level (e.g., L4 nerve supplies the L4 multifidus muscles at that same level). Correcting the muscles at this level requires that the segments are correctly aligned and mobile for proper functioning to occur. The muscle group, the multifidus, is the most medial portion of the lower back muscles and has two roles in the spine that are accomplished using two types of muscle fibers systems. There is a deep or type I fiber system and also a superficial or type II fiber system. Type I fibers control the intersegmental motion and give inherent stability to the spine itself, while the type II superficial system aide in trunk movement patterns (i.e., flexion, side flexion, and rotation). If there is a segmental inhibition at one of the lumbar spine levels, this leads to alterations in the firing pattern that is sent to the type I and II multifidus fibers which can cause segmental changes (hyper or hypomobility) due to the poor firing to that particular fiber bundle.

However, if the multifidus muscles of the lower back are targeted and strengthened, this can restore the strength in the deep muscles of the lumbar spine enabling the muscles to function normally. The result is that the patient will then have less back pain permitting their quality of life to be restored or, at the very least, improved to a level that is not only functional, but enjoyable.

Thus, there is a need and there has never been disclosed Applicant's unique apparatus for isolating lower back muscles.

III. SUMMARY OF THE INVENTION

The present invention is an exercise equipment apparatus for isolating lower back muscles. The apparatus or device comprises main tubular support posts, secondary tubular support posts, and support feet for providing the foundation of the device. Inner tubular extensions and setting pins are used to adjust the height and length of the device to accommodate the particular size and the proper positioning of the user for the angle of strengthening desired. A removeable torso support is releaseably attached or coupled to one of the main tubular support posts. An angular setting guide is used to select or set the desired angle of use and an articulating lever attached to the removeable torso support provides an arm for stopping or setting the removeable torso support at the selected angle of use by the user.

IV. BRIEF DESCRIPTION OF THE DRAWINGS

The Description of the Preferred Embodiment will be better understood with reference to the following figures.

Figure 3:
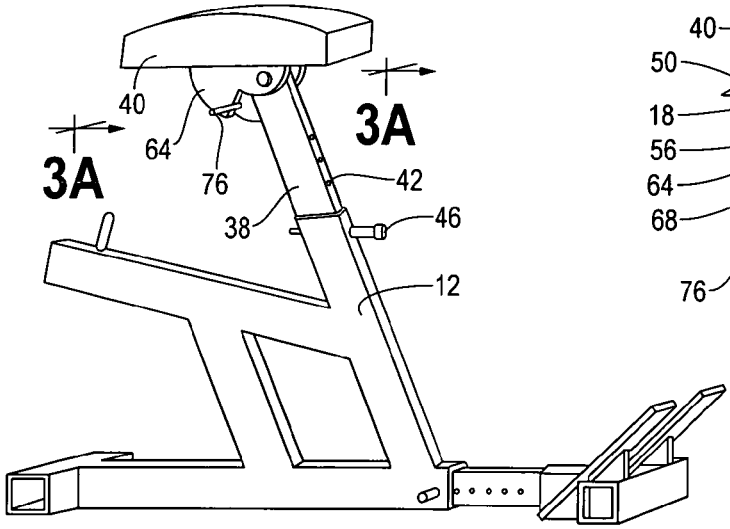
FIG. 3 is a side perspective view of the right side of Applicant's device and, in particular, illustrating the device in the compressed position to accommodate use by smaller users.
Figure 3A:
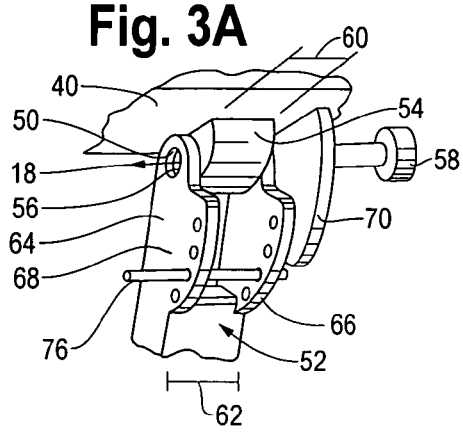

FIG. 3*a* is an end perspective view, taken along line 3A-3A of FIG. 3, illustrating the angular setting guide with respect to the torso support.

Figure 4:
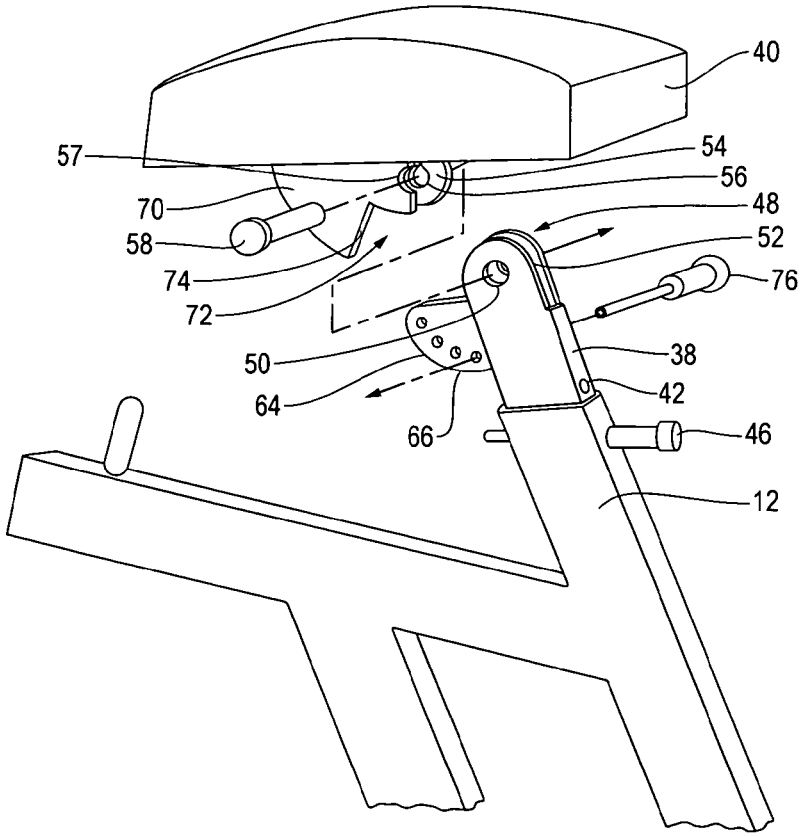

FIG. 4 is a side perspective view of the right side, with portions removed, illustrating the releaseable attachment of the torso support to the device.

Figure 5A:
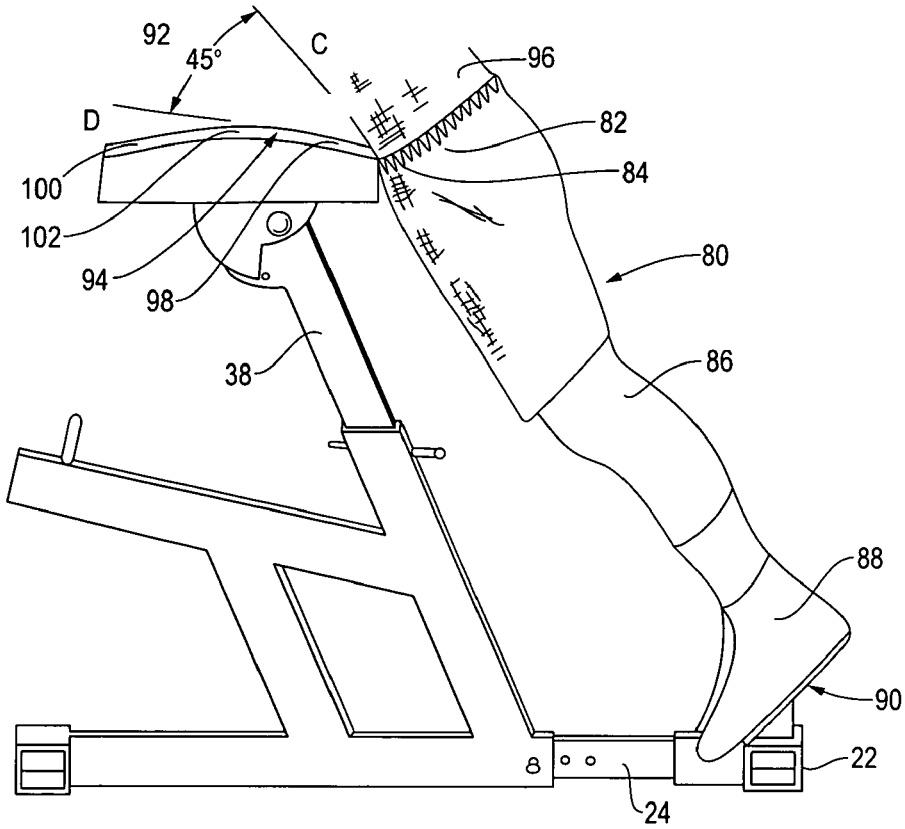

FIG. 5*a* is a side perspective view of the device illustrating the angular setting guide set at a forty-five degree angle (45°) for use by the user.

Figure 5B:
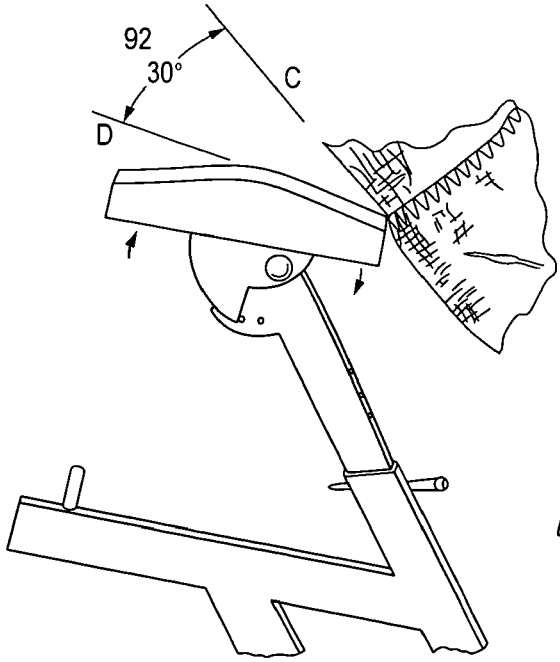

FIG. 5*b* is a side perspective view of the device illustrating the angular setting guide set at a thirty degree angle (30°) for use by the user.

Figure 5C:
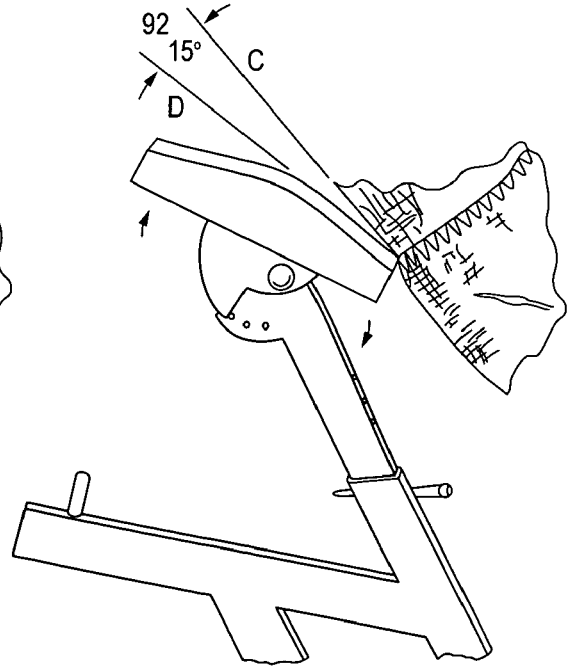

FIG. 5*c* is a side perspective view of the device illustrating the angular setting guide set at a fifteen degree angle (15°) for use by the user.

Figure 6:
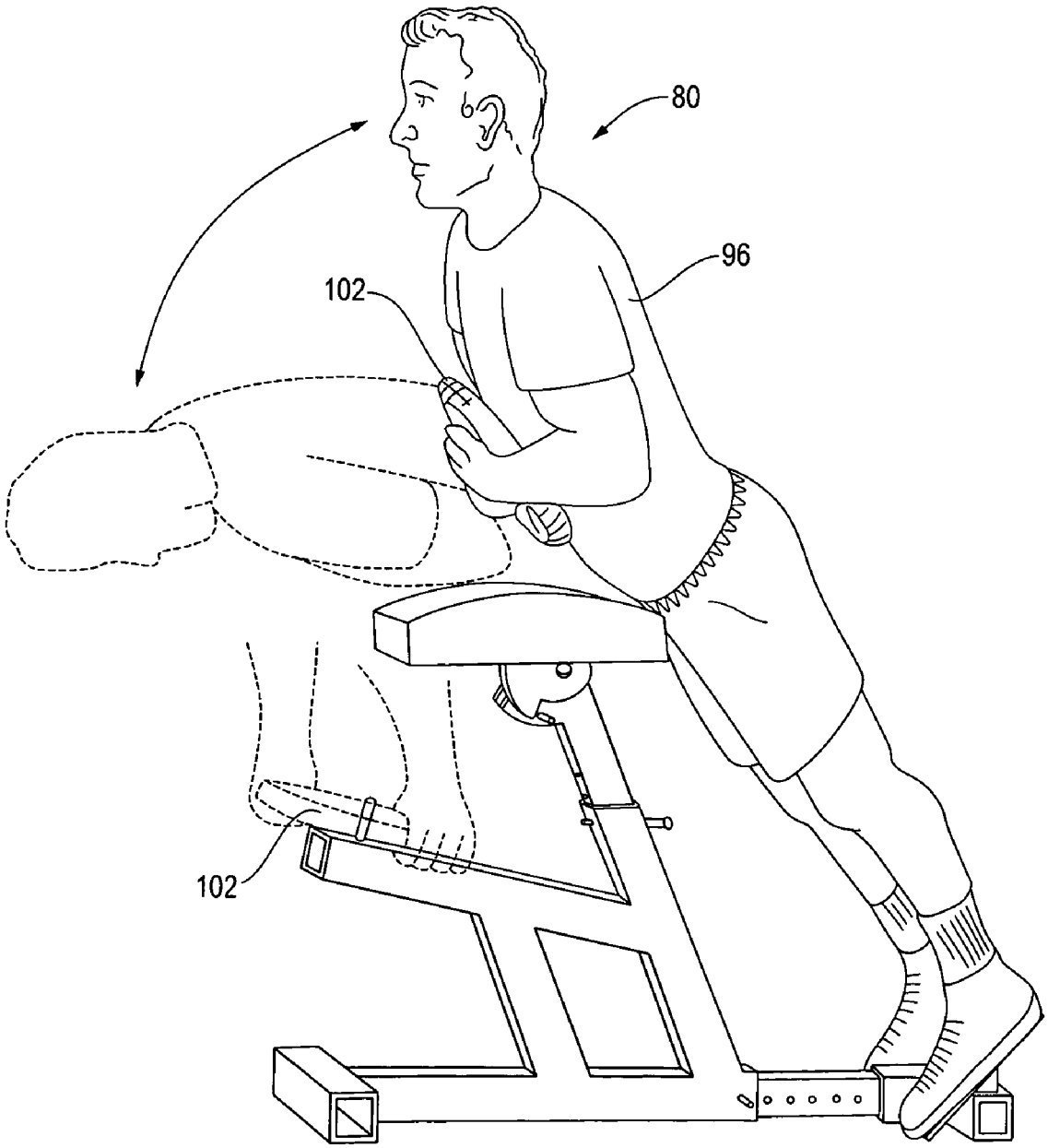

FIG. 6 is a side perspective view of the device in use by a user and, in particular, illustrating the proper positioning for using the device and added use of a weight for increased strengthening.

V. DETAILED DESCRIPTION OF THE PREFERRED EMBODIMENT

Figure 1:
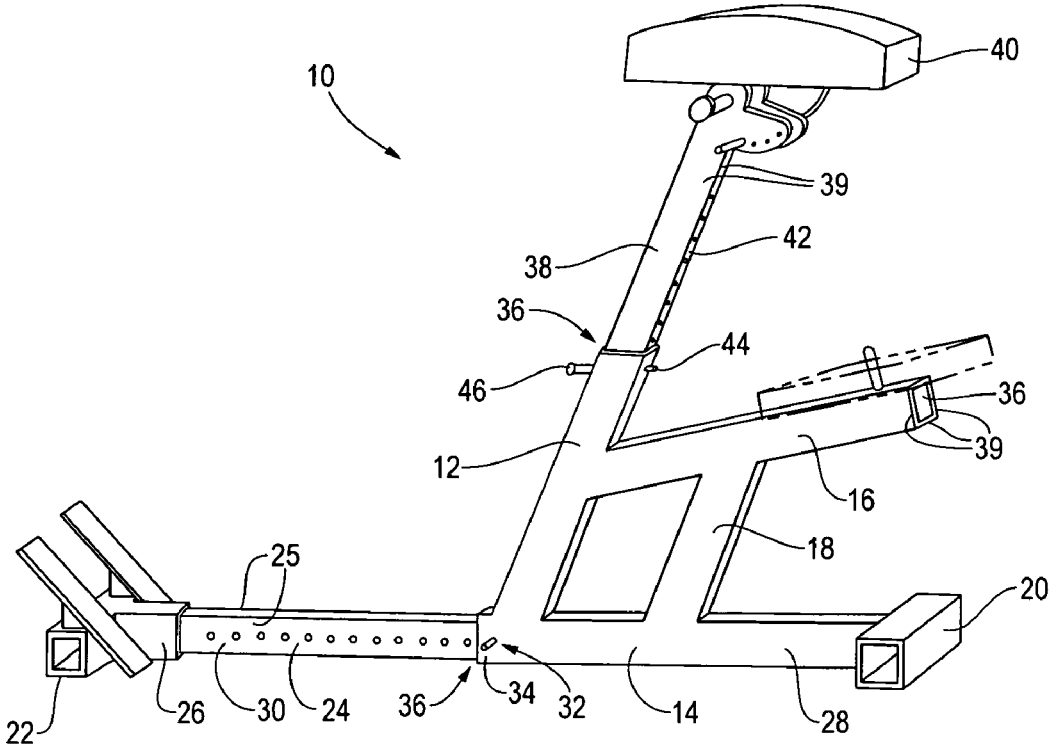
FIG. 1 is a perspective view of the left side of Applicant's invention for a lower back muscle isolator device and, in particular, illustrating the device in an expanded position to accommodate use by taller users.

Turning first to FIG. 1, there is illustrated Applicant's exercise equipment apparatus 10 for isolating a person's lower back muscles. The device 10 comprises interconnecting main tubular support posts 12 and 14 and secondary tubular support posts 16 and 18. The main tubular support posts 12, 14 and secondary tubular support posts 16, 18 are preferably rectangular in shape having sides 19 forming a square cross-section with a hollow center 36. Alternatively, the main tubular support posts 12, 14 and secondary tubular support posts 16, 18 may be in any other shape provided that this alternate shape accomplishes the invention as described herein. Support feet 20 and 22 are situated at opposite ends of the main tubular support post 14. The support feet 20 and 22 are preferably positioned at perpendicular angles to each end of the main tubular support post 14 for forming an "I" shape between them. In this manner, the combination of the main tubular support posts 12, 14, the secondary tubular support posts 16, 18, and the support feet 20, 22 coact to provide the foundation or support frame of the device 10.

An inner tubular extension 24 is located within the main tubular support post 14. The inner tubular extension 24 is preferably rectangular in shape having sides 25 forming the same square cross-section as the main tubular support post 14. Alternatively, should the main tubular support post 14 be of a different shape, the inner tubular extension 24 should likewise be of the same shape. Additionally, the square cross-section of the inner tubular extension 24 (as measured from the exterior) should have a height and width which is slightly less than the height and width of the main tubular support post 14 (as measured from the interior) or, in other words, slightly less than the height and width of the hollow center 36 formed within the main tubular support post 14. In this manner, the inner tubular extension 24 may releaseable traverse or freely move lengthwise within and through the hollow center 36 of the main tubular support post 14. Additionally, due to the minor tolerances or differences in height and width between these tubular members, the square cross-sectional shape of perpendicular sides 19 of the main tubular support post 14 will forceably prevent the square cross-sectional shape of perpendicular sides 25 of the inner tubular extension 24 from laterally rotating or spinning within the main tubular support post 14.

Figure 2:
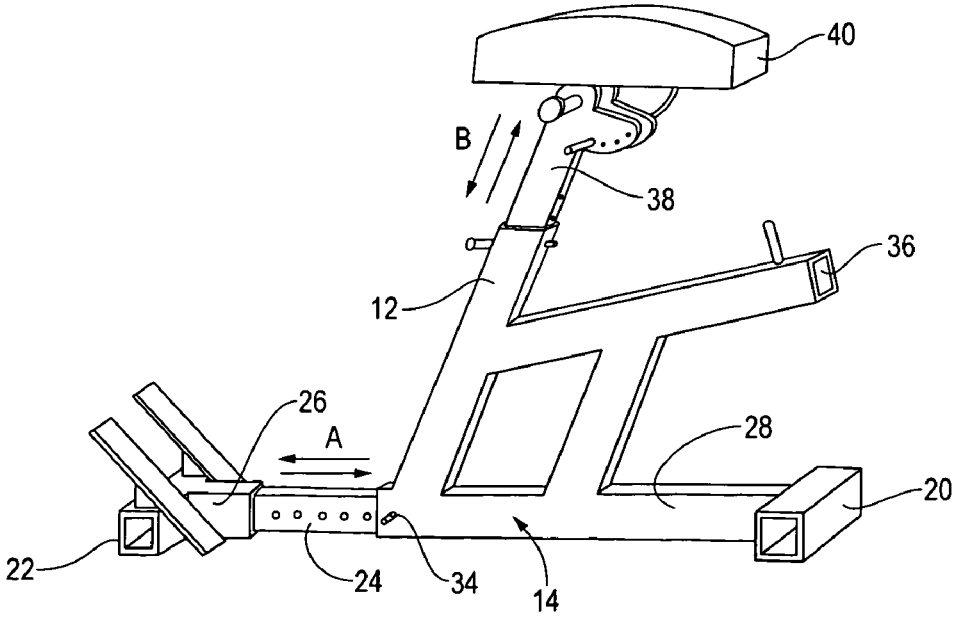
FIG. 2 is a side perspective view of the left side of Applicant's device and, in particular, illustrating the device in a compressed position to accommodate use by smaller users.

In the preferred embodiment, the main tubular support post 14 is separated or divided into sections 26 and 28. One end of the inner tubular extension 24 is fixedly secured to section 26 of the main tubular support post 14 adjacent the support foot 22. The other end of the inner tubular extension 24 remains free to traverse or move within and through the hollow center of section 28 of the main tubular support post 14 toward and away from the support foot 20. As the inner tubular extension 24 releaseably traverses or freely moves within and through the hollow center of section 28 of the main tubular support post 14, the inner tubular extension 24 is provided with a plurality of inner tubular holes 30 equally spaced lengthwise along the inner tubular extension 24. The main tubular support post 14 is also provided with an exterior tubular hole 32. When the inner tubular extension 24 is moved in either direction of Arrow A (see FIG. 2) and adjusted to the proper position relative to the main tubular support post 14 for use by a user, one of the plurality of inner tubular holes 30 becomes aligned with the exterior tubular hole 32 in this position. When this occurs, a setting pin 34 is inserted through the exterior tubular hole 32, through the inner tubular hole 30 and completely through the hollow center of the inner tubular extension 24 and main tubular support post 14 to like corresponding holes on the other side. In this manner, the setting pin 34 locks the inner tubular extension 24 into the proper position relative to the main tubular support post 14 for use by a user.

Another inner tubular extension 38 is located within the main tubular support post 12. This inner tubular extension 38 is preferably rectangular in shape having sides 39 forming the same square cross-section as the main tubular support post 12. Alternatively, should the main tubular support post 12 be of a different shape, the inner tubular extension 38 should likewise be of the same shape. Additionally, the square cross-section of the inner tubular extension 38 (as measured from the exterior) should have a height and width which is slightly less than the height and width of the main tubular support post 12 (as measured from the interior) or, in other words, slightly less than the height and width of the hollow center 36 formed within the main tubular support post 12. In this manner, the inner tubular extension 38 may releaseable traverse or freely move lengthwise within and through the hollow center 36 of the main tubular support post 12. Additionally, due to the minor tolerances or differences in height and width between these tubular members, the square cross-sectional shape of perpendicular sides 19 of the main tubular support post 12 will forceably prevent the square cross-sectional shape of perpendicular sides 39 of the inner tubular extension 38 from circumferentially rotating or spinning within the main tubular support post 12.

In the preferred embodiment, one end of the inner tubular extension 38 is releasably attached or coupled to a removable torso support 40 or pad as discussed in more detail later in the specification. The other end of the inner tubular extension 38 remains free to traverse or freely move within and through the hollow center 36 of the main tubular support post 12. As the inner tubular extension 38 releaseably traverses or freely moves within and through the hollow center 36 of the main tubular support post 12, the inner tubular extension 38 is provided with a plurality of inner tubular holes 42 equally spaced lengthwise along the inner tubular extension 38. The main tubular support post 12 is also provided with an exterior tubular hole 44. The inner tubular extension 38 may then be moved in either direction of Arrow B (see FIG. 2) and adjusted to the proper position relative to the main tubular support post 12 for use by a user. When this occurs, one of the plurality of inner tubular holes 42 becomes aligned with the exterior tubular hole 44 in this position. A setting pin 46 is then inserted through the exterior tubular hole 44, through the inner tubular hole 42 and completely through the hollow center of the inner tubular extension 38 and the main tubular support post 12 to like corresponding holes on the other side. In this manner, the setting pin 46 locks the inner tubular extension 38 into the proper position relative to the main tubular support post 12 for use by a user.

Turning to FIGS. 3, 3A, and 4, the releasable attachment of the inner tubular extension 38 to the removable torso support 40 is more clearly illustrated. In particular, the inner tubular extension 38 is provided with a pair of spacially aligned semi-circular teeth 48, each having an eye-hole 50, and separated by a slot 52. A torso support base 54 is attached to the removable torso support 40. The torso support base 54 is preferably semi-circular in shape and disposed with a center eye-hole 56. In the preferred embodiment, the torso support base 54 has a width 60 that is slightly less than the slot width 62. In this manner, the torso support base 54 may releaseable traverse or freely move within the slot 52 between the circular teeth 48 for alignment of the center eye-hole 56 with the corresponding eye-holes 50. When this occurs, the center eye-hole 56 becomes aligned between both of the eye-holes 50 in the circular teeth 48. An attachment pin 58 is then inserted through an articulating lever 70 (discussed below), one of the eye-holes 50 in one of the circular teeth 48, through the center eye-hole 56 of the torso support base 54, and out through the other eye-hole 50 in the other of the circular teeth 48. In this manner, the attachment pin 58 attaches or completes the coupling of the inner tubular extension 38 to the removable torso support 40. Once attached or coupled together, the removeable torso support 40 is free to rotate circumferentially about the attachment pin 58 and pivot axis 78. Due to the minor tolerances or differences in width between the torso support base 54 and the slot 52 between the circular teeth 48, the circular teeth 48 will forceably prevent the torso support base 54 from laterally rotating or moving between the circular teeth 48.

In addition, due to the releasable attachment or coupling means of the torso support base 54, the removeable torso support 40 can be releaseably attached or coupled to any other type of exercise equipment adapted for releaseably attaching or coupling to the removeable torso support 40.

In the preferred embodiment, an angular setting guide 64 is fixedly secured to the inner tubular extension 38 adjacent to the circular teeth 48. The angular setting guide 64 consists of a pair of identical disc plates 66 that extend outwardly and parallel from each of the circular teeth 48. Each disc plate 66 is provided with a plurality of substantially identical, equally spaced, angle holes 68. In the preferred embodiment, there are a total of four angle holes 68 that represent the angles of zero degrees (0°), fifteen degrees (15°), thirty degrees (30°), and forty-five degrees (45°), respectively. Alternatively, the number of the plurality of angle holes 68 may be larger or smaller and represent larger or smaller angle of degrees, as desired.

In the preferred embodiment, to adjust the removeable torso support 40 to accommodate the angle holes 68 from the angular setting guide 64, the removeable torso support 40 is provided with the articulating lever 70. The articulating lever 70 extends from the removeable torso support 40 adjacent to and parallel with the torso support base 54 but separated a distance from the torso support base 54 sufficient for one of the circular teeth 48 to be received between them. The articulating lever 70 further provides an identical eye-hole 57 for accommodating the releaseable attachment or coupling of the removeable torso support 40 as described above. The articulating lever 70 also comprises a cutout 72 for forming an arm 74.

To use the angular setting guide 64, the user inserts an angular setting pin 76 into and through one of the angle holes 68 in one of the disc plates 66 and continues insertion of the angular setting pin 76 into and through the equally aligned angle hole 68 in the other disc plate 66. In this manner, depending upon which angle hole 68 is used, the angular setting pin 76 sets the angle at either zero degrees (0°), fifteen degrees (15°), thirty degrees (30°), or forty-five degrees (45°). Once the angle is set, the removeable torso support 40 is rotated on the torso support base 54 about the pivot axis 78 established by attachment pin 58 until the arm 74 of the articulating lever 70 engages the angular setting pin 76. When this occurs, the arm 74 and the angular setting pin 76 coact as a stopping means for setting the removeable torso support 40 at the angle set by the angular setting guide 64. As illustrated in FIGS. 5A, 5B, and 5C, for example, the removeable torso support 40 is shown set at the angles of fifteen degrees (15°), thirty degrees (30°), and forty-five degrees (45°), respectively.

In the preferred embodiment, for a user 80 to use the device 10 at the desired angles, the user 80 should position their waist 82 on the edge 84 of the removeable torso support 40. The user 80 should then straighten out their legs 86 and place their feet 88 flat against a foot platform 90 situated above the support feet 22. In this manner, the lower body of the user 80 is situated or positioned in a substantially straight line parallel to and in alignment with line C. The user 80 should also position their the upper torso 96 such that it is likewise parallel to and in alignment with the lower body and line C. As further illustrated, a straight line D is shown extending from the edge 84 of the removeable torso support 40 and along the contour of the top surface 94 of the removeable torso support 40. In combination, line C and line D define the measurement of an angle 92 which corresponds directly to the angle set by the user 80 with the angular setting guide 64.

Also, in the preferred embodiment, the top surface 94 of the removeable torso support 40 is designed into an arcing shape thereby defining or separating the top surface 94 of the torso support 40 into a green zone 98 and a red zone 100. The arcing shape also provides a ridgeline 102 that assists in the separation of the green zone 98 from the red zone 100.

Should the waist 82 not be positioned on the edge 84 of the removeable torso support 40, the feet 88 not be flat against the foot platform 90, or the lower body of the user 80 not be substantially in a straight line as described above, the inner tubular extension 24 and/or the inner tubular extension 38 should be properly adjusted in either direction to accommodate the particular body size (e.g., height and body length) of the user 80 until the proper positioning is achieved. In the preferred embodiment, this proper positioning should be obtained prior to beginning use of the device (i.e., starting position).

When this starting position is achieved, the user 80 is ready to begin use of the device 10. If, for example, the fifteen degree (15°) angle is selected by the user 80 and set (see FIG. 5C), the user's starting position is parallel to and in alignment with line C. To begin then, the user 80 bends or pivots about their waist 82. As this occurs, the upper torso 96 begins to engage the top surface 94 of the removeable torso support 40 in the green zone 98. As the user 80 continues, the upper torso 96 continues engagement with the top surface 94 within the green zone 98 until the user 80 reaches the ridgeline 102. When the upper torso 96 reaches the ridgeline 102 (i.e., end of the green zone 98 of the top surface 94 of the removeable torso support 40), the user's upper torso 96 will be parallel to and in alignment with line D. At this point, the user 80 stops (i.e., stopping position) and then begins to move the upper torso 96 back toward the starting position. A full movement from the starting position to the stopping position and then from the stopping position back to the starting position is referred to as a repetition. The user 80 may perform as many repetitions as desired. This repetition process is also further illustrated in FIG. 6. Should the user 80 continue movement of the upper torso 96 into the red zone 100 of the top surface 94, this would then begin to put an undue stress on the lower back muscles which the user 80 should avoid. Throughout this use, the lower body of the user 80 (e.g., legs 86 and feet 88) remains unchanged and parallel to and in alignment with line C.

During this process or repetition, the device 10 is forcing the user 80 to isolate their deep back stabilizing muscles, especially the multifidus muscles, in the lumbar spine to perform the repetition. Depending upon the condition of the user's 80 lower back muscles and pain, the user 80 preferably should begin the using the device 10 at the zero degree (0°) angle to avoid loading the spine and muscles too strenuously. As the lower back muscles and deep multifidus muscles are strengthened, the angle can be gradually increased from zero degrees (0°) to fifteen degrees (15°), then again to, thirty degrees (30°), and then when ready, again to forty-five degrees (45°). Each increasing angle likewise increasingly activates the multifidus (deep back stabilizing muscle) to perform the repetition. As these deep multifidus muscle system type one, deep muscle system aerobic system, and type two, fast fatigable system of the multifidus (superficial muscle group) are isolated by the device 10 in these gradually increasing angles, the intersegmental motion of the muscles will become stronger and more controllable thereby decreasing or avoiding the chance for segmental dysfunctions and lower back pain.

Additionally, as illustrated in FIG. 6, weights 102 may be used by the user 80 to increase the difficulty of the repetition for increasing the contraction of the multifidus fibers at the deep and superficial level and further increasing the strengthening of these muscles and the lower back.

Thus, there has been provided Applicant's unique apparatus for isolating lower back muscles. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. An exercise apparatus for isolating and strengthening lower back muscles of a user, comprising:

a substantially upright support frame having a length, an upper end and a lower end;

a torso support having a top surface and a bottom surface, the top surface defining an angle with respect to the support frame, the top surface adapted for supporting the torso of the user;

opposed teeth extending outwardly from the upper end of the support frame and defining a slot between them, each opposed teeth having an eye-hole;

a base extending outwardly from the bottom surface of the torso support, a center hole disposed through the base;

an attachment pin;

whereby, the base is received into the slot between the opposed teeth until the center hole is aligned with each of the eye-holes in the opposed teeth for coacting to define a channel between them thereby enabling the attachment pin to be inserted through channel and attaching the torso support to the support frame;

means for adjusting the length of the support frame; and means for adjusting the angle of the top surface of the torso support.

2. The exercise apparatus of claim 1 wherein the means for adjusting the angle of the top surface of the torso support comprises an angular setting guide attached adjacent to the upper end of the support frame and having two sets of a plurality of holes, each hole in the plurality of holes of one set correspondingly aligned with one of the holes in the plurality of holes of the other set for defining a plurality of grouping holes, the plurality of grouping holes each defining a particular angle; an articulating lever extending outwardly from the bottom surface of the torso support; and an angular setting pin; whereby, the angular setting pin is inserted through one of the plurality of grouping holes and the articulating lever is rotated for engagement with the angular setting pin thereby fixing the torso support relative to the support frame at the particular angle.

3. The exercise apparatus of claim 2 wherein the angular setting guide comprises opposed disc plates situated parallel to one another and each having one of the sets of the plurality of holes.

4. The exercise apparatus of claim 1 and further comprising a foot platform upon which the user's feet are placed.

5. The exercise apparatus of claim 1 wherein the top surface of the torso support is in an arcing shape.

6. The exercise apparatus of claim 1 wherein the top surface of the torso support is separated into a first zone which is adapted to receive the user's torso and provide a range of motion for isolating and strengthening the lower back muscles, and a second zone which defines a second range of motion greater than the first range of motion.

7. The exercise apparatus of claim 6 wherein the first zone and the second zone are separated by a ridgeline.

8. An apparatus for a user to exercise their lower back muscles, comprising:

a substantially upright support frame having a length, an upper end, a lower end and a foot platform;

a torso support having a top surface and a bottom surface, the torso support rotatably affixed to the support frame; and an adjustment structure for adjusting the torso support in relation to the support frame for defining an angle of the top surface of the torso support with respect to the foot platform comprising:

an angular setting guide attached adjacent to the upper end of the support frame and having two sets of a plurality of holes, each hole in the plurality of holes of one set correspondingly aligned with one of the holes in the plurality of holes of the other set for defining a plurality of grouping holes, the plurality of grouping holes each defining a particular angle;

an articulating lever extending outwardly from the bottom surface of the torso support; and an angular setting pin;

whereby, the angular setting pin is inserted through one of the plurality of grouping holes and the articulating lever is rotated for engagement with the angular setting pin thereby fixing the torso support relative to the support frame at the particular angle; and whereby, upon standing on the foot platform, the torso support is used to engage the waist of the user and, during a repetition, support a portion of the torso at the angle to exercise the lower back muscles.

9. The apparatus of claim 8 wherein the frame comprises a substantially horizontal first support post and a substantially upright second support post, the first support post angled in relation to the second support post.

10. The apparatus of claim 9 wherein the first support post and the second support post are tubular in shape and each having a hollow center.

11. The apparatus of claim 10 wherein a first inner tubular extension freely traverses through the hollow center of the first support post and a second inner tubular extension freely traverses through the hollow center of the second support post.

12. The apparatus of claim 11 and further comprising means for releaseably securing the first inner tubular extension to the first support post and means for releaseably securing the second inner tubular extension to the second support post.

13. The apparatus of claim 12 wherein the means for releaseably securing the first inner tubular extension to the first support post comprises a plurality of opposed holes in the first inner tubular extension; an exterior tubular hole in the first support post; and a setting pin; whereby, the first inner tubular extension is received into the hollow center of the first support post until the desired one of the plurality of opposed holes in the first inner tubular extension are aligned with the exterior tubular hole in the first support post for coacting to define a channel between them thereby enabling the setting pin to be inserted through channel and attaching the first inner tubular extension to the first support post.

14. The apparatus of claim 13 wherein the means for releaseably securing the second inner tubular extension to the second support post is substantially the same as the means for releaseably securing the first inner tubular extension to the first support post.

15. The apparatus of claim 11 wherein the foot platform is fixedly attached to the first inner tubular extension opposite the first support post and the torso support is rotatably affixed to the second inner tubular extension opposite the second support post.

16. The apparatus of claim 15 wherein the frame is adjusted to accommodate the size of the user upon one or both of the first inner tubular extension and the second inner tubular extension being releaseably secured into a desired position in relation to the first support post and second support post, respectively.

* * * * *